United States Patent [19]

Marulic et al.

[11] 4,266,487

[45] May 12, 1981

[54] RAILWAY PASSENGER CAR WINDOW FRAMING CONSTRUCTION

[75] Inventors: Walter J. Marulic, Gary; Jack E. Gutrigde, Dyer, both of Ind.

[73] Assignee: Pullman Incorporated, Chicago, Ill.

[21] Appl. No.: 949,822

[22] Filed: Oct. 10, 1978

[51] Int. Cl.[3] ..... B61D 17/00; B61D 25/00; B61D 49/00

[52] U.S. Cl. ..... 105/397; 49/488; 52/398; 105/329 R; 105/401; 105/423

[58] Field of Search ..... 49/485, 488; 52/397, 52/398, 403; 105/329 R, 315, 397, 401, 423; 296/178

[56] References Cited

U.S. PATENT DOCUMENTS

| | | | |
|---|---|---|---|
| 2,184,614 | 12/1939 | Farr | 105/329 R |
| 2,297,051 | 9/1942 | Dean | 105/397 |
| 2,575,454 | 11/1951 | Kuhler | 105/397 |
| 2,589,997 | 3/1952 | Dean et al. | 105/315 X |
| 2,595,858 | 5/1952 | Kuhler | 105/329 R |
| 2,925,050 | 2/1960 | Candlin, Jr. et al. | 105/401 X |
| 3,072,229 | 1/1963 | Pasche et al. | 49/485 X |
| 3,194,299 | 7/1965 | Butler | 49/485 X |
| 3,214,879 | 11/1965 | Ellingson, Jr. et al. | 49/488 X |
| 3,596,980 | 8/1971 | Cadiou | 49/485 X |
| 3,981,107 | 9/1976 | Schubach | 52/56 |

FOREIGN PATENT DOCUMENTS

| | | | |
|---|---|---|---|
| 1048453 | 4/1953 | France | 105/397 |
| 59122 | 12/1953 | France | 52/398 |

*Primary Examiner*—Howard Beltran
*Attorney, Agent, or Firm*—Richard J. Myers

[57] ABSTRACT

This disclosure relates to a structure for mounting and interconnecting adjacent windows in a railway passenger vehicle. Windows are mounted in resilient sealing gaskets which are held with a locking clamp that is mounted in a wall attached, resilient seal member. Interconnecting the interior adjacent windows is a framing member having an inside, peripheral end that fits within the locking clamp encircling the windows and has an outside periphery held in place by a rigid, plastic, snap-on sealing mask which interconnects the outside edges and holds each securely in place between the adjacent windows.

16 Claims, 3 Drawing Figures

RAILWAY PASSENGER CAR WINDOW FRAMING CONSTRUCTION

BACKGROUND OF THE INVENTION

1. Field of the Invention

This invention pertains to railway passenger vehicles and in particular to a construction for mounting windows in the passenger vehicles for ease of assembly and disassembly.

2. Description of the Prior Art

Earlier railway passenger vehicles have included a number of windows mounted in various manners and separated by large sections of framing ranging from one foot (30 cm.) to three feet (90 cm.). With such a structure, the window framing, that portion of the car extending from the window, across the sill and into a plane with the inside wall sheets, had edges spaced apart a considerable distance. This spacing was usually covered with a so-called decorator panel which was attached at each vertical edge to an associated window frame.

The trend today is to provide more windows making it necessary to mount the windows closely together. Thus, the window framing is large enough to extend from adjacent each window to the window framing of the adjacent windows. Because of this shorter spacing between windows, the generally used decorator panels are no longer necessary and a construction was required which would provide a decorative yet functional arrangement overlapping adjacent edges of the window framing and which would securely mount windows to allow windows to be easily accessed for replacement purposes from within the car.

SUMMARY OF THE INVENTION

This disclosure relates to a manner of mounting and holding windows in railway passenger vehicles. Additionally, a window frame is provided on the inside of the vehicle which provides a decorative, yet a functional, frame which assists in holding the window securely in place. Although the window frame holds the window in place, the frame may be easily removed to allow the window to be removed and/or repaired from the inside of the vehicle.

Each window frame has an outside edge or periphery which abuts the frame of an adjacent window and is interconnected to each frame by a resilient, plastic mask which covers the exposed, inside edges of the window frame and provides a decorative, functional interior to the vehicle. The mask member snaps in place and may be easily removed to expose fasteners which hold the window frames in position. Thus, once the mask is removed the window frames may also be removed from the inside of the car to expose clamp members that hold the window glass in place to remove the glass.

Each window frame includes a flat, inside wall section and a beveled periphery extending from the inside section to a point adjacent the window. The inside edge of the periphery includes an attaching end which snaps into a glass-holding, clamp-like member which is mounted in a rubber glazing strip attached to the outside sheets of the vehicle and which securely holds the sealed edge of the window glass securely in position. The outside edges of the window frame in the car interior are securely held down by horizontally and vertically extending mask members.

The window clamp member which also retains an inside periphery of the window frame is a rigid, vice-like member having two sections positioned about a resilient gasket that has an end portion which positions the clamp securely within the wall portion of the vehicle. Thus, to remove the windows all that is necessary is that the mask be snapped from a position adjacent the window frames after which fasteners holding the window frame in position can easily be removed along with the one portion of the window gripping clamp to allow the window to be easily removed or repaired.

It is an object to disclose a window arrangement wherein adjacent window frames are overlapped by decorative yet functional mask members which are easily removed for disassembly and access to windows for removal or repair.

It is another object of this disclosure to show a continuous window clamping member having a fastener exposed to the car interior, thus allowing the clamping member to be dismantled and the window removed or repaired.

These and other objects of the invention will become apparent to those having ordinary skill in the art with reference to the following drawings, description, and appendant claims.

DESCRIPTION OF THE PREFERRED EMBODIMENT

Figures 1, 2:
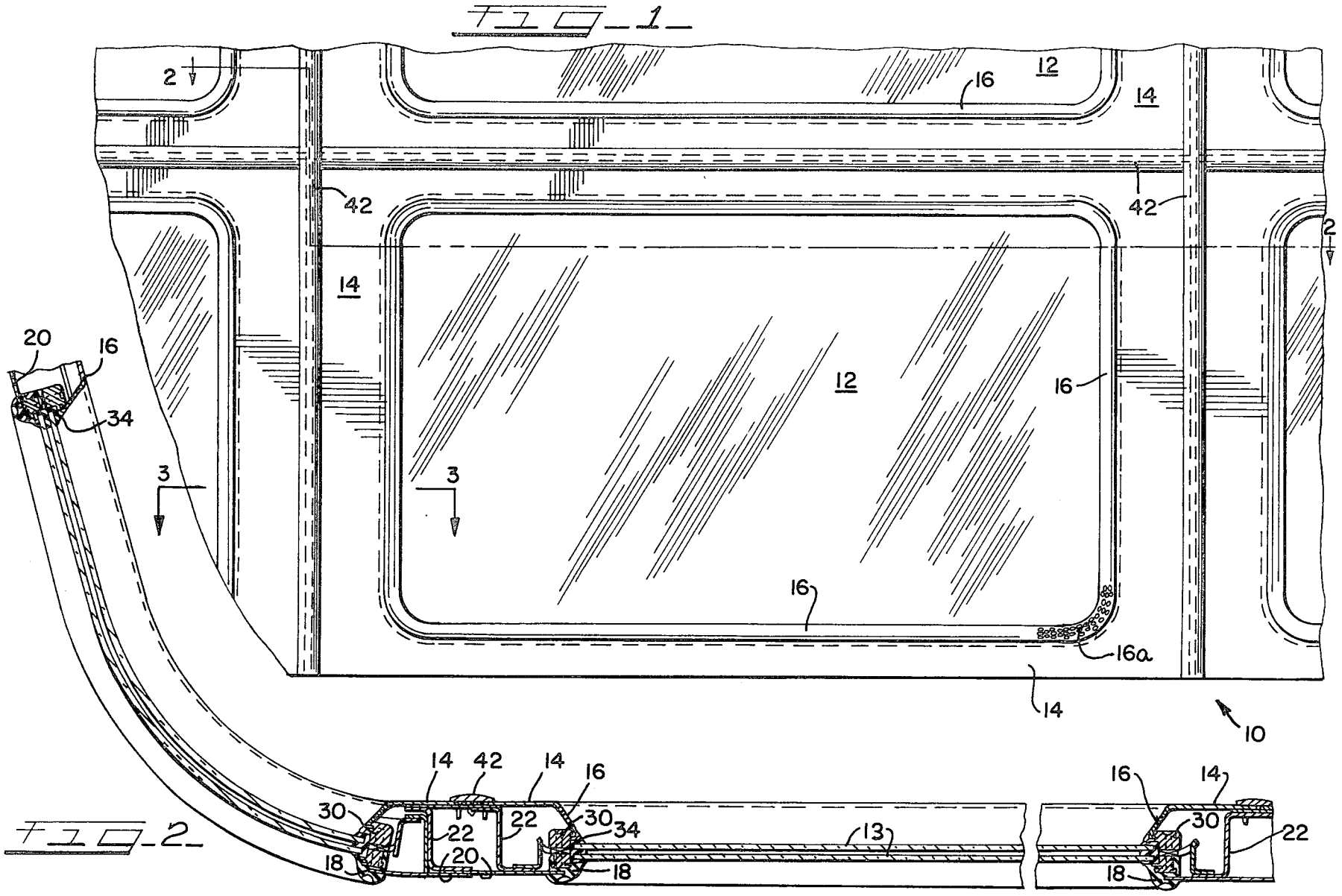
FIG. 1 is a removed view of a side wall of a railway passenger vehicle.
FIG. 2 is a sectional view taken generally along lines 2—2 of FIG. 1.
Figure 3:
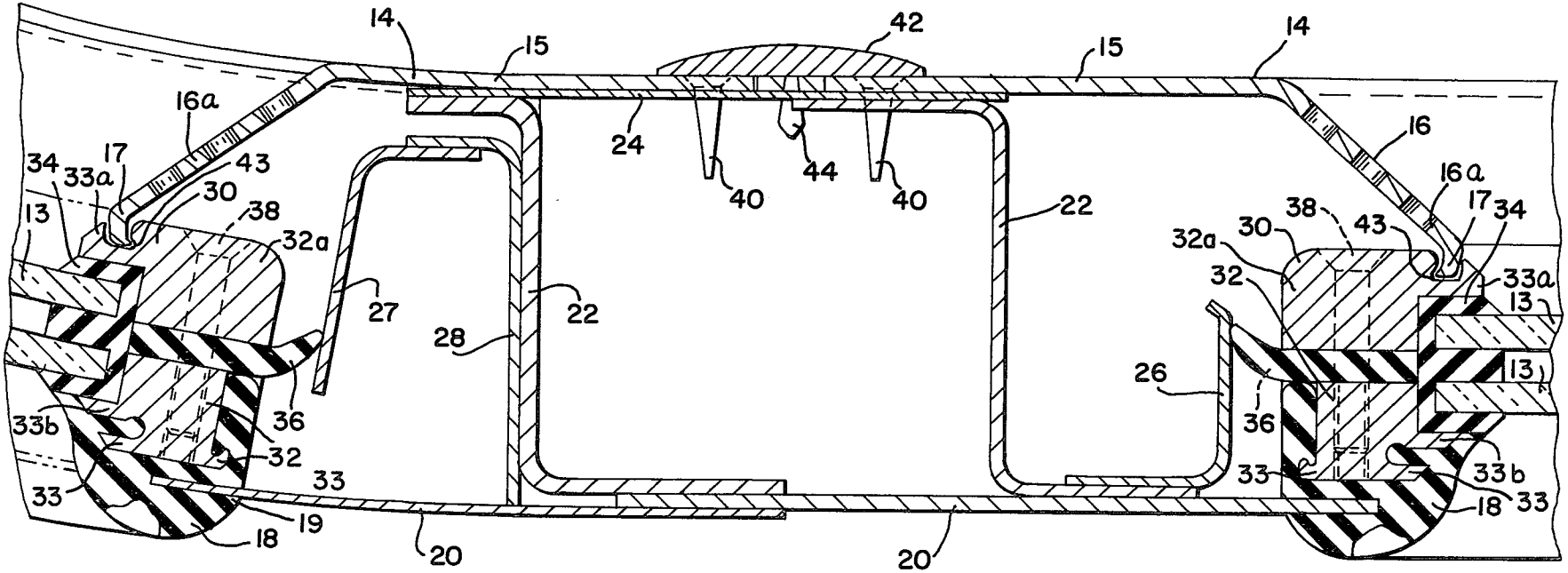
FIG. 3 is a cross-sectional view taken generally along the lines 3—3 of FIG. 1.

Referring now to the drawings and in particular to FIG. 1, there is shown a sightseer railroad passenger car 10. As illustrated, car 10 includes two levels of windows 12 which are closely spaced together to insure that the viewing area is maximized. A cowling-type member or window frame 14 of an essentially annular shape is positioned about each window 12 and includes a center portion 15 and extending therefrom a beveled or inclined section 16. As shown in FIGS. 1 and 3, a portion of the beveled section 16 may include a number of openings **16*a* to allow heating and cooling air to be circulated to the car interior. As shown in FIG. 3, the inside fitted end of the beveled portion 16 is designated 17 and is snapped into position and held by locking clamp 30** as will be discussed further.

Window 12 is generally contemplated as being a so-called thermal pane window made from safety glass and comprising an inner and outer glass portions or window means 13 separated by an air space. Double window construction is conventional on railway passenger cars and insures both safety and comfort for the car occupants. As shown in FIG. 3, a glazing sealing strip 18 fits around the outside of the window opening in the car wall structure and has one slotted end 19 to receive outer, side sheets 20 of the railway vehicle 10. Wall posts 22 interconnect outer sheets 20 with an internal connector plate 24 which completes a so-called box beam wall column construction which rigidifies the car wall structure. Also included within the hollow wall portion are a pair of spacer angles 26, 27 which assist in positioning and holding glass 12 and its seal 34 securely in place to prevent longitudinal and vertical movement.

Spacer angle 27 may be directly attached to the wall posts 22 or may be positioned with the use of an auxiliary plate 28.

As shown in the illustrations, the glass members 13 are held in place with the use of a glass lock clamp 30, also serving as a separable frame therefor. The glass clamp lock 30 has first and second annular locking members 32 and 32*a*, respectively. The first locking member 32 has extended flanges 33 embedded in the sealing strip 18 for securely attaching said member thereto. The first and second locking members 32 and 32*a* have jaw portions 33*a*, 33*b*, respectively, for applying a gripping force to a resilient glass enclosure or seal 34, surrounding the periphery of and spacing glass portions 13. Separating the two members of the clamp 30 is a resilient spacer washer or gasket 36 extended therefrom for cooperation with the spacer angles 26 and 27. Fasteners or screws 38 project through both clamp members 32, 32*a* and through the spacer washer 36 to tighten all members securely together to hold the window glass or similar transparent material portions 13 in position and seal out air and moisture. As noticed in FIG. 3, when the screws 38 are tightened, the jaw portions 33*a*, 33*b* will squeeze the window seal 34 into a tight, secure position to hold the glass portions 13 in place.

The inside window frames 14 have an outer periphery of the center portion 15 with extending edges which are abutted with the same of adjacent windows and covered by a plastic, snap-on mask 42 which is positioned atop screws 40 which extend through the edges of window frames 14 and into the side wall of the vehicle 10. The jaw 33*a* of the second locking member 32*a* has a recess 43 cooperating with the fitted end portion 17 of the frame inclined portion 16. Mask 42 includes a snap-in type of retainer 44 which is fitted through appropriately located and sized openings in the side wall to enable the mask 42 to be easily fitted into and removed from position overlapping adjacent edges of the window frames 14.

It is noticed from the foregoing structure that in the event that it is necessary to replace a window, all that is necessary is that the plastic mask or molding 42 be removed from the edges of the window frame 14 surrounding the window to be replaced. Removing the mask 42 exposes fasteners 40 removal whereof would allow the window frame 14 to be completely detached from the wall sections. After frame 14 is removed, fasteners 38 which are positioned in the glass lock clamp 30 are exposed to the inside of the vehicle. Removal of fasteners 38 causes separation of the second locking member 32*a*, the jaw of which extends around the inside periphery of the windows 12, from the first locking member 32 being trapped in the sealing strip 18. This separation of the clamp lock serving as a frame for the window glass allows the removal of the exposed resilient enclosure and window glass portions therein without effecting the positioning of the glazing sealing strip 18 and first locking member 32. Similarly, when a new glass is initially inserted in a resilient window seal or enclosure 34, the window glass 13 and seal 34 may be easily repositioned as a unit in the clamp jaw 33*b* of the first member 32. After such positioning, a resilient spacer washer 36 and the second lock clamp member 32*a* may be realigned and fasteners 38 inserted and tightened to secure the windows in position. Next, the fitted end portions 17 of the window frames 14 are snapped into the associated recess 43 of the jaw 33*a*. Finally, fasteners 40 are reapplied and masking member 40 snapped back into position. As is noticed from the foregoing, windows may be easily replaced and are held in position by locking clamping and sealing members which provide a reliable yet easily accessible combination of elements.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A railway passenger car with side wall construction comprising:

a wall structure with a window opening therein, a resilient sealing strip member extending about the periphery of said window opening, window means being positionable within and removably connected with said sealing strip member, detachable clamp locking means for maintaining locking and alignment of said window means with said sealing strip member and interconnected with said resilient strip member, and a window frame member defining the window and being removably attached to said wall structure and said clamp locking means.

2. The invention according to claim 1, wherein said clamp locking means comprises:

a first locking member being removably connected with and carried by said sealing strip member, a second locking member removably attached to the first locking member by mechanical fasteners, and resilient gasket means disposed between said first and second locking members, whereby said first and second locking members secure said window means within said resilient strip member.

3. The invention according to claim 2, and said gasket means having an extension portion, spacer means mounted on the wall structure and engaging with said extension portion of said gasket means for positioning and stabilizing said locking means and window means in space.

4. The invention according to claim 2, said first locking member having flanges embedded in said sealing strip member for securely attaching said first member thereto.

5. The invention according to claim 2, and said locking members having jaw portions for applying a gripping force to said resilient enclosure, said frame member having an end portion, and the jaw portion of the second locking member having a recess portion engaging with the end portion of said window frame member.

6. The invention according to claim 1, and a resilient enclosure surrounding the periphery of and dividing spaced portions of said window means.

7. The invention according to claim 6, wherein said clamp locking means comprise first and second locking members, said first and second locking members having jaw portions for applying a gripping force to said resilient enclosure of the window means, and tightening fasteners projecting through said first and second locking members for connection thereof and for adjusting of said gripping force.

8. The invention according to claim 1,
said locking means extending about the periphery of said window means and being separable into first and second locking frames for said window means.

9. The invention according to claim 1,
said window frame member being of an essentially annular shape surrounding the window means and further comprising
outer edge portions contiguous with and connected to said wall structure,
inclined portions having a portion at the end thereof for engaging with said locking means.

10. The invention according to claim 9, and
fastener means attaching said window frame member to said wall structure,
mask means having portions overlapping outer edge portions of said window frame member, where
said mask means locates and attaches the mask means in position with a snap element for manual attachment and removal.

11. A railway passenger vehicle with a wall structure having a window construction comprising:
a window opening in the wall structure,
removable window means being disposed within said window opening,
detachable clamp locking means for alignment and securement of said window means within said wall structure,
said clamp locking means encompassing said window means and defining separable frame components to remove the window means, and
interior window frame means having an outer portion being removably attached to the wall structure and having an inner portion being in a releasably locking arrangement with one of said frame components.

12. A railway passenger car comprising:
a wall structure including a vertical post,
a window frame mounted on said post,
window clamp locking means being connected with said window frame and adapted to carry an associated window therein,
said clamp means including resilient means for clasping the associated window and lock means disposed about said resilient means for compressingly holding said resilient means tight against the associated window,
said lock means including a pair of locking elements one disposed on each side of the resilient and securing means tightening said locking elements compressingly against the resilient means,
said resilient means having a compressible portion between said locking elements, and
said post being provided with an extension engageable with the compressible portion of said resilient means to force the clamp means toward the window opening.

13. A railway passenger car comprising:
a wall structure,
a window frame mounted on said wall structure,
window clamp locking means being connected with said window frame and adapted to carry an associated window pane therein,
said clamp means including resilient means for clasping the associated window and lock means disposed about said resilient means for compressingly holding said resilient means tight against the associated window,
said lock means including a pair of locking elements one disposed on each side of the resilient and securing means tightening said locking elements compressingly against the resilient means,
holding means capturing one of the locking elements, and
side sheet means connecting the wall structure with said holding means.

14. A railway passenger vehicle comprising:
a wall structure disposed between a pair of associated windows,
a pair of window frames removably secured on said wall structure in tandem spaced relationship longitudinally of the car and each frame defining a respective window,
said frame members having facing edges defining a seam and a mask means extending vertically of the car covering said seam, annular lock means located substantially in a vertical plane of the window and operatively connected with a respective window frame and provided with resilient cushioning means adapted to surround and embrace and hold in place an associated window in a clamping, and
further means connecting said lock means with the wall structure.

15. The invention according to claim 14, and
gasket means held by said lock means and spacer means operatively secured with said wall structure and engaging said gasket means for urging the lock means toward an associated window.

16. The invention according to claim 14, and
said wall structure having a side sheet means and a resilient sealing strip connecting with each lock means and with a respective sheet means for holding the lock means and absorbing shock directed force to the window opening.

* * * * *